US005357271A

United States Patent [19]

Wiklof et al.

[11] Patent Number: 5,357,271

[45] Date of Patent: Oct. 18, 1994

[54] THERMAL PRINTHEAD WITH ENHANCED LATERLA HEAT CONDUCTION

[75] Inventors: Christopher A. Wiklof, Everett; Kenneth D. Lakey, Bothell, both of Wash.

[73] Assignee: Intermec Corporation, Everett, Wash.

[21] Appl. No.: 5,664

[22] Filed: Jan. 19, 1993

[51] Int. Cl.[5] ..... B41J 2/335

[52] U.S. Cl. ..... 346/76 PH

[58] Field of Search ..... 340/76 PH; 400/719

[56] References Cited

FOREIGN PATENT DOCUMENTS 0063287 5/1980 Japan ..... 346/76 PH
0180853 9/1985 Japan ..... 346/76 PH
0173656 7/1988 Japan ..... 346/76 PH

*Primary Examiner*—Benjamin R. Fuller
*Assistant Examiner*—Huan Tran
*Attorney, Agent, or Firm*—Seed and Berry

[57] ABSTRACT

A thermal printhead incorporating an elongated heat conduction chamber which is oriented in alignment with an array of printhead heating elements and used to transfer heat along the array to equalize heat distribution. The chamber contains a heat transfer fluid and wicks. The fluid when in a liquid state absorbs heat at a hot spot along the array through evaporation, transports the heat along the array to cooler portions of the chamber as a gas through gas dynamics and localized pressure, condenses to the liquid form, and returns to the hot spot through the capillary action of the wicks. In another embodiment, a metal strip is used to distribute the heat along the heating element array between hot and cool portions of the array.

17 Claims, 4 Drawing Sheets

THERMAL PRINTHEAD WITH ENHANCED LATERLA HEAT CONDUCTION

DESCRIPTION

1. Technical Field

The present invention relates to thermal control of a thermal printhead having an array of resistive heating elements.

2. Background of the Invention

Thermal printheads are well-known devices found in a wide variety of commercially available printers. In addition to printing text, one commercial use for a thermal printhead is in the printing of bar code labels.

Typical thermal printers utilize a printhead with a linear array of resistive heating elements. The array of heating elements is often formed using a narrow continuous length of resistive material with a plurality of intersecting conductive leads which can be selectively energized to selectively heat lengthwise portions of the resistive material. Each of the heating elements can be selectively heated by providing an electric current through a chosen conductive pathway incorporating the heating element. The array is often mounted on a base or substrate which provides mechanical support and heat stabilization for the heating elements.

Selective application of current to selected heating elements allows each element of the thermal printhead to be separately activated at a given point in time. As a thermally sensitive paper or thermally sensitive transfer film and paper combination is passed by the printhead, the various heating elements are activated to selectively heat and thereby print a selected image on a selected portion of the print medium.

A common problem associated with such printers is inadequate control of the heat generated by the printhead, particularly those regions of the printhead that have been repeatedly activated such that a large residual heat buildup results (i.e., hot spots are formed). Heat conduction through the support substrate helps cool the heating elements, but this sometimes provides inadequate heat dissipation. Because many thermal printers utilize an electrically nonconductive ceramic substrate, the substrate tends not to be a good thermal conductor. While many excellent thermal conductors exist, they are also electrically conductive and cannot be used to directly support the heating elements. To help improve heat dissipation, the ceramic substrate is often mounted on a conductive second layer which acts as a heat sink. The second layer is typically manufactured of aluminum metal.

If a heating element or group of adjacent heating elements are repeatedly heated during a print job, the heavy heating schedule will cause excessive localized heating of the ceramic substrate and the heat sink near these heating elements. Eventually, this residual heat buildup will cause future printing with these printing elements to become much darker than the printing that is produced by other heating elements of the thermal printhead. This results because the heating elements and surrounding material in the area of the localized heat buildup are already at an elevated temperature when activated for printing, so the heating elements possess a higher apparent thermal efficiency during subsequent activations of the heating elements (i.e., when activated a greater portion of the heat generated by the activated heating elements is transferred to the print medium). The apparent thermal efficiency increase can be great enough that the printing will be significantly darker than the printing by the same heating elements before the localized heating buildup occurred, and perhaps more significantly, darker than the current printing being produced by the heating elements in the areas of the printhead where little or no localized heat buildup has occurred.

With a conventional linear array of heating elements, this results in one portion of the array printing darker than another portion. When printing a bar code label, one lengthwise portion of a bar may be printed darker than another lengthwise portion of the same bar, causing difficulties when the bar code is subsequently read by an optical reader. In situations where the localized heat buildup is extreme, the darkening can be great enough that resolution is lost as a result of the smearing of print edges or the general overall darkening of the portion of the print medium passing over the area where the localized heat buildup has occurred.

One technique for reducing the effects of localized heat buildup is to modify the current pulse for a heating element as a function of its heating history and the history of its neighboring elements. Such a technique has limitations, because of the volume of data and the number of calculations necessary for adequate compensation. Currently, this makes it feasible to only consider data accumulated for short time periods. However, the problem of localized heat buildup is usually the result of a heavy heating schedule for a heating element which extends over a relatively long time period, far longer than can feasibly be considered by the compensation technique. Even with such a technique, if a localized heat buildup should occur, there is no mechanism for handling the problem.

SUMMARY OF THE INVENTION

The present invention resides in a thermal printhead for printing on a thermally sensitive medium, where the print medium is movable relative to the printhead in a direction of printing. The printhead includes a support base having a first side positionable toward the print medium and a reverse second side, and a plurality of heating elements mechanically attached to the first side of the support base. The heating elements are arranged to define an array extending generally transverse to the direction of printing. The heating elements generate heat when activated for thermal printing. The heating elements are positioned in proximity with the print medium to transfer heat thereto during thermal printing.

The printhead further includes an elongated heat conduction member positioned to absorb heat generated by the heating elements. The conduction member is oriented in general alignment with the array to distribute any absorbed heat along the length of the array. The conduction member distributes the residual heat generated by any heating elements along a first portion of the array greater than the residual heat generated by other heating elements along a second portion of the array to the location of the other elements to equalize the temperature along the array.

In several embodiments of the invention, the conduction member is a fluid-tight conduction chamber containing a heat transfer fluid in a liquid state which changes to a gaseous state above a preselected temperature. The heating elements generate temperatures in the conduction chamber below the preselected temperature when operating below a normal activation schedule. The heating elements generate temperatures in the conduction chamber along a first portion of the array at or above the preselected temperature when the heating elements along the first portion of the array are operating under a heavier than normal activation schedule. As such, the heat generated by the heating elements in a portion of the conduction chamber along the first portion of the array operating under the heavier than normal activation schedule will generate a temperature above the preselected temperature and cause the heat transfer fluid to change from the liquid state to the gaseous state. While in the gaseous state the heat transfer fluid moves longitudinally through the conduction chamber to a cooler portion thereof whereat the heat transfer fluid returns to the liquid state and transfers heat to the heating elements along the second portion of the array.

The conduction chamber further includes a wick enclosed within and extending longitudinally through the conduction chamber. The wick is comprised of a material which transports the heat transfer fluid when in the liquid state lengthwise along the conduction chamber through capillary action. In one embodiment, the conduction chamber is formed from a tube having both ends sealed with the heat transfer fluid therewithin.

In other embodiments of the invention, the conduction member is a strip of thermally conductive material having a higher thermal conductivity than the support base.

In some embodiments, the conduction member is at least partially embedded within the support base on the second side thereof. In one embodiment, the conduction member is attached to the second side of the support base and is in thermal contact therewith.

In one embodiment, the conduction member is positioned between the heating elements and the support base.

In most embodiments, the printhead includes a heat sink having a first side positioned toward and in thermal contact with the second side of the support base. The conduction member in one embodiment is partially embedded within the support base and partially embedded within the heat sink. In this embodiment, the interior walls of the conduction chamber are formed from mating grooves formed in the support base and the heat sink. Fluid leakage is prevented from between the support base and the heat sink by the use of a fluid-tight seal therebetween. The seal may take the form of a gasket.

In another embodiment, the conduction chamber is formed fully embedded within the heat sink.

Other features and advantages of the invention will become apparent from the following detailed description, taken in conjunction with the accompanying drawings.

DETAILED DESCRIPTION OF THE INVENTION

Figure 1:
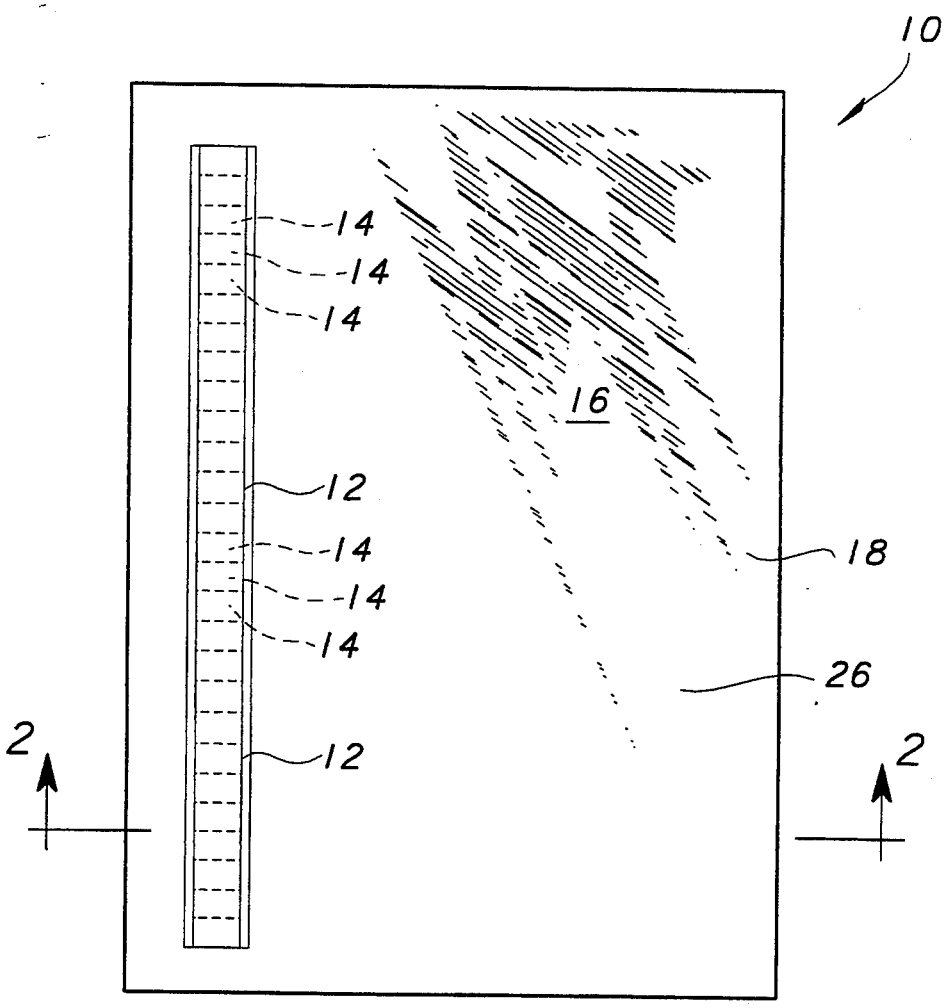
Figure 1 (Prior Art)
FIG. 1 is a top plan view of a printhead of the prior art with a linear array of thermal heating elements.
Figure 2:
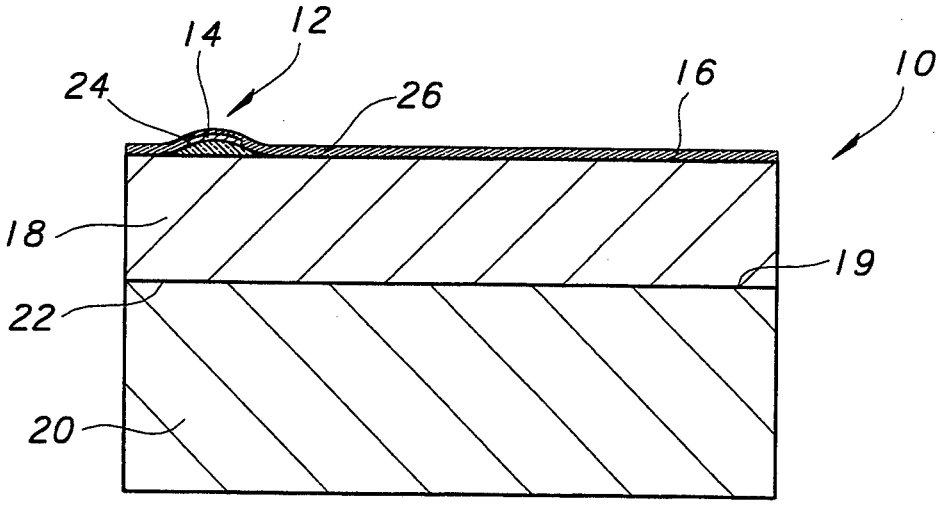
Figure 2 (Prior Art)
FIG. 2 is a cross-sectional view of the prior art printhead taken substantially along line 2—2 of FIG. 1.

A typical prior art thermal printhead 10 is shown in FIGS. 1 and 2. The printhead 10 has a linear array 12 of resistive heating segments or elements 14 mounted on an upper surface 16 of a ceramic support base or substrate 18. An upper surface 19 of a heat sink 20 is mounted to a lower surface 22 of the ceramic substrate 18 in thermal contact therewith. The heating elements 14 are formed as a continuous strip of a resistive material intersected by conductive leads (not shown). Typically, the heating elements 14 are formed atop a continuous strip of underglaze 24 deposited on the upper surface 16 of the ceramic substrate 18. A thin protective glass overglaze 26 is applied over the heating elements 14, the exposed edge portions of the underglaze 24 and a portion of the upper surface 16 of the ceramic substrate 18.

The heating elements 14 with their protective overglaze 24 form a continuous print bead extending transverse to the direction of movement of the thermally sensitive print medium (not shown). The print bead is in direct contact with the print medium when printing. It is to be understood that while the printhead 10 is illustrated as having the upper surface facing upward, the printhead may be oriented as desired so long as the printhead is operated with the upper surface 16 facing toward the print medium.

The printhead 10 operates by passing a current through selected ones of the heating elements 14. As the current passes through the selected heating elements 14, the activated heating elements produce thermal energy. This thermal energy causes the temperature of the selected heating elements 14 to rise to a nominal operating temperature at which the print medium is heat sensitive and the printing of a darkened pixel by each of the selected heating elements results.

The heat energy produced within the selected heating elements 14 by this resistive heating which is not transferred to the print medium during the thermal printing process, is transported away from the selected heating elements by thermal conduction and radiation. The amount of such heat dissipated via the overglaze 26 to the atmosphere by thermal conduction is low. Consequently, much of the residual heat generated by the selected heating elements 14 is conducted to the ceramic substrate 18. Thermal energy generated by a particular one of the selected heating elements 14 which is transferred to the ceramic substrate 18 will be subsequently transferred to the heat sink 20 located below the ceramic substrate.

Since a large, highly thermally conductive material such as aluminum is typically used for the heat sink 20, the temperature of the ceramic substrate 18 can usually be maintained within a suitable temperature range for proper operation of the printhead 10. However, if one of the selected heating elements or a group of adjacent selected heating elements are repeatedly activated for printing, i.e., have a heavy heating schedule, the thermal conductivity of the heat sink 20 is sometimes insufficient to transport away heat quickly enough from the ceramic substrate 18 to maintain it within a suitable operating range. This results in an undesirable localized residual heat buildup occurring in the ceramic substrate 18 and the heat sink 20 which degrades printhead performance, as previously described.

While improvements in the thermal conduction of heat to the heat sink 20 will help reduce the general heat buildup in the ceramic substrate 18, a single heating element 14 or adjacent heating elements in the array 12 and the portion of the ceramic substrate thereabout may still become hotter than other heating elements and surrounding ceramic substrate, producing uneven print darkness along the length of the array.

Figure 3:
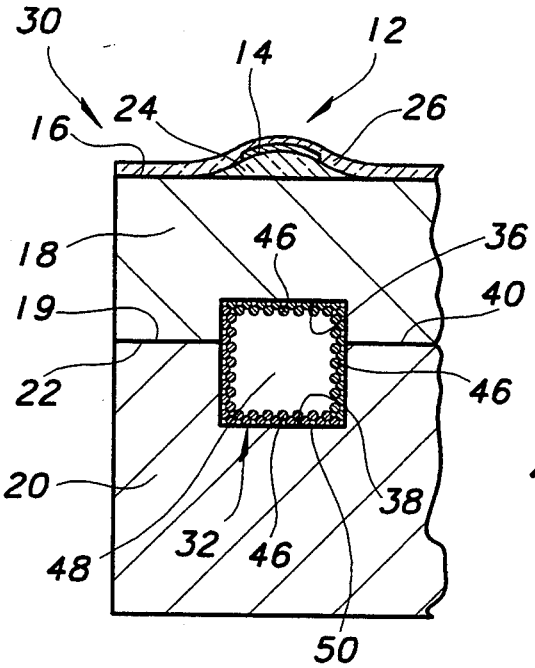
FIG. 3 is a fragmentary, cross-sectional view of a first embodiment of a thermal printhead incorporating the present invention.
Figure 4:
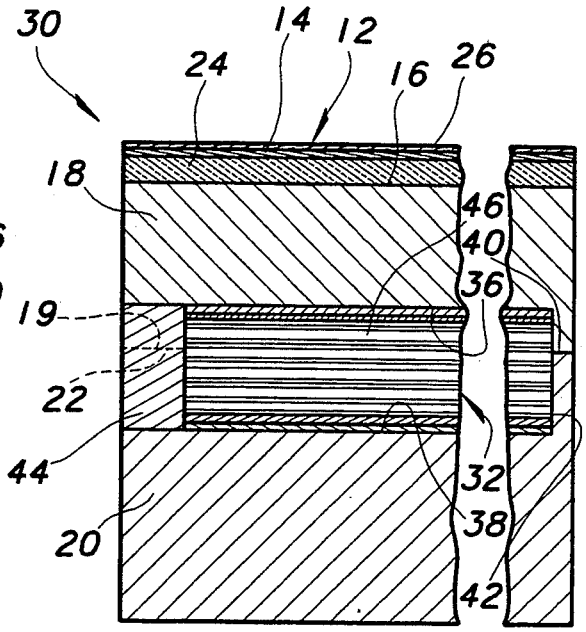
FIG. 4 is a fragmentary, side elevational cross-sectional view of the printhead of FIG. 3.

A first embodiment of a thermal printhead 30 made according to the present invention is shown in FIGS. 3 and 4. For clarity, the same reference numerals as used in FIGS. 1 and 2 will be used for the embodiment of FIGS. 3 and 4 and all other described embodiments of the invention to identify similar components.

The printhead 30 includes a fluid-tight, elongated chamber 32 forming a closed containment vessel extending below and substantially colinear with the heating element array 12. The chamber 32 is formed from a trench or groove 36 machined or otherwise formed in the lower surface 22 of the ceramic substrate 18 which is aligned with a corresponding trench or groove 38 machined or otherwise formed in the upper surface 19 of the heat sink 20. A hermetic seal 40 is formed between the lower surface 22 of the ceramic substrate 18 and the upper surface 19 of the heat sink 20 to prevent fluid leakage from the chamber 32 between the ceramic substrate and the heat sink. The chamber 32 has an integrally formed solid end wall 42 sealing one end thereof, and a plug 44 sealing the other end thereof. Porous capillary wicks 46 are disposed within the chamber 32 and extend the full length of the chamber. The wicks 46 are positioned against the interior longitudinal sidewalls of the chamber 32. Preferably, the wicks 46 do not completely fill the chamber 32, but leave a central passageway 48 formed between the wicks 46 which extends the full length of the chamber. The wicks 46 may be woven cloth, fiberglass, porous metal, wire screen, porous ceramic, narrow grooves cut lengthwise in the interior longitudinal sidewalls, or thin corrugated and perforated metal sheet. The chamber is evacuated of substantially all air and a heat transfer fluid 50 is sealed within the chamber 32.

As will now be described, the chamber 32 is designed to accomplish the lateral transfer of heat across the printhead 30, along the heating element array 12 so that all heating elements 14 in the array are operating at a sufficiently similar temperature to avoid the undesirable localized residual heat buildup discussed above. As previously discussed, localized heat buildup causes the heating elements 14 of the array 12 with a heavy heating schedule to print darker than desired and darker than the remaining heating elements of the array which do not have a heavy heating schedule. The chamber 32 distributes the heat from any such localized heat buildup (i.e., hot spot) laterally across the printhead 30, along the length of the array 12 so that no one portion of the heating elements (and their surrounding ceramic substrate and heat sink material) is operating at a significantly higher temperature than the other heating elements in the array. The lateral heat transfer is accomplished passively with the chamber 32 acting as a heat pipe, as will now be described. As with the conventional thermal printhead 10, the function of dissipating the heat to the environment is still performed primarily by the heat sink 20.

When the printhead 30 is not in operation, the heat transfer fluid 50 within the chamber 32 is comprised of a thin liquid film on the interior walls of the chamber 32 dispersed longitudinally throughout the chamber 32 through the capillary action produced by the wicks 46 and in the vapor state within central passageway 48. When the printhead 30 is in operation and a selected portion of the heating elements 14 are activated sufficiently often to produce a local area of residual heat buildup, the heat transfer fluid 50 in the portion of the chamber therebelow is heated to boiling and evaporates, absorbing heat energy. As the heat transfer fluid 50 evaporates, it expands and increases the localized pressure in that portion of the chamber 32. The resultant localized pressure causes the evaporated fluid in the gaseous state to travel longitudinally through the central passageway 48 of the chamber 32 toward portions of the chamber which are cooler. Upon reaching a cooler chamber portion the heat transfer fluid 50 returns to its liquid state, releasing its latent heat energy to that cooler chamber portion, raising its temperature. The liquid then returns via the wicks 46 to the portion of the chamber with the localized heat buildup through the capillary action of the wicks.

This process continues between the portions of the chamber 32 with localized heat buildup and the cooler chamber portions until the entire chamber and all heating elements 14 (and surrounding ceramic substrate/heatsink material) in the array 12 are at generally the same temperature with all hot spots eliminated. The net result is that residual heat is more quickly transferred and more evenly distributed laterally across the printhead 30 and along the heating element array 12, thus preventing localized heat buildup in any one portion of the array.

The composition and pressure for the heat transfer fluid 50 in the chamber 32 is selected to match the desired operating temperature range for the printhead 30 and depends on the type of heating elements 14 utilized. In the embodiment described above, a typical operating temperature range is 40°-50° C. Water at about 2 PSIA, methanol at about 7 PSIA, or fluorinert 72 at about 12 PSIA may be used as the heat transfer fluid 50.

Figure 5:
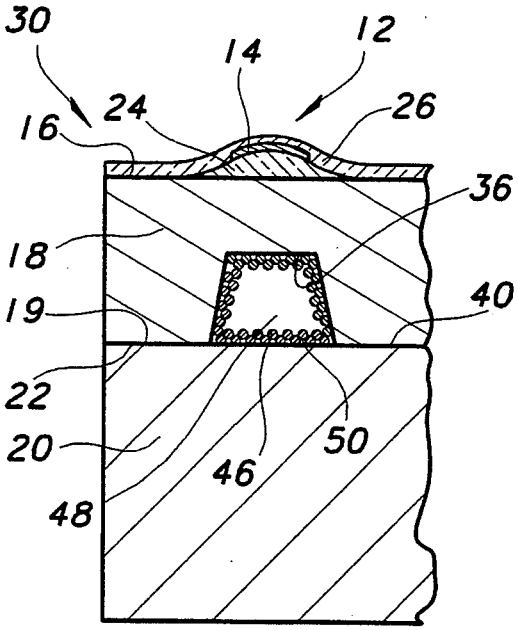
FIG. 5 is a fragmentary, cross-sectional view of an alternative second embodiment of the invention.
Figure 6:
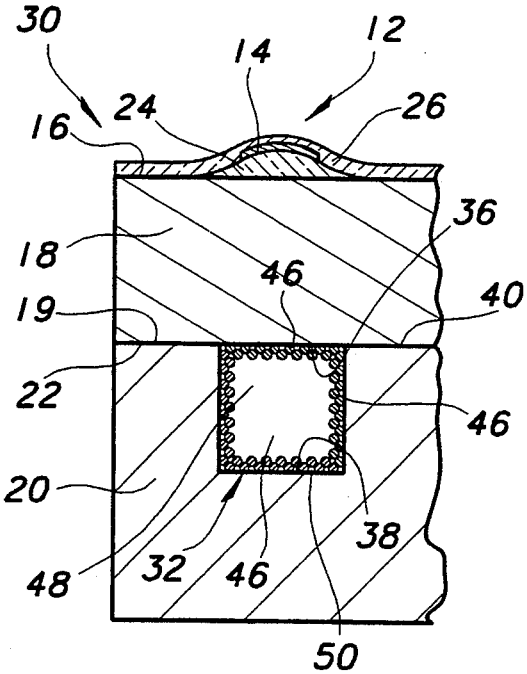
FIG. 6 is a fragmentary, cross-sectional view of an alternative third embodiment of the invention.

While the embodiment of FIGS. 3 and 4 has been described in detail, other embodiments of the invention are possible without departing from the scope of the invention. For example, in FIG. 5 an alternative embodiment is shown with the chamber 32 formed fully within the ceramic substrate 18 using only the groove 36, thus eliminating the groove 38 in the heat sink 20. A portion of the upper surface 19 of the heat sink does form one interior sidewall of the chamber 32. Similarly, as shown in FIG. 6, the chamber 32 can be formed fully within the heat sink 20 using only the groove 38 in the heat sink. Here, a portion of the lower surface 22 of the ceramic substrate does form one interior sidewall of the chamber 32. Each of these embodiments is otherwise constructed much as with the embodiment of FIGS. 3 and 4.

Figure 7:
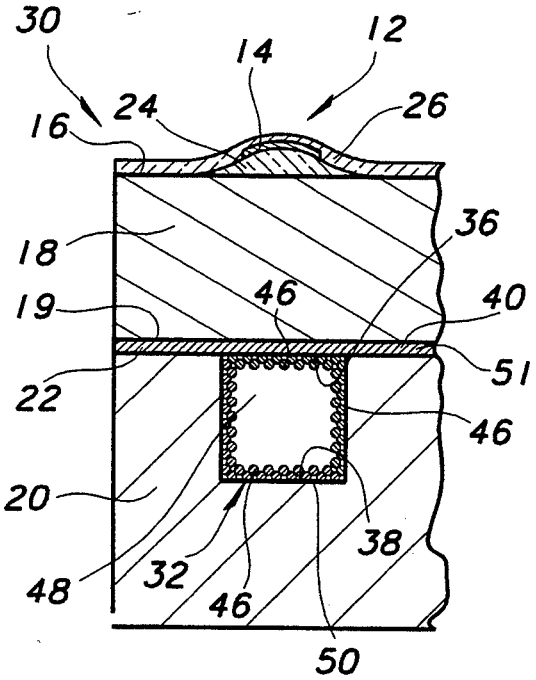
FIG. 7 is a fragmentary, cross-sectional view of an alternative fourth embodiment of the invention very similar to the embodiment of FIG. 6.

If necessary to improve the seal, a gasket 51 may be used to provide the hermetic seal 40, as shown in FIG. 7. The embodiment of FIG. 7 is very similar in construction to the embodiment of FIG. 6. The embodiment of FIG. 7 allows the charging of the chamber 32 with the transfer fluid 50 prior to assembly of the ceramic substrate 18 to the aluminum heat sink 20, with the one surface of the gasket 51 acting as one of the interior sidewalls of the chamber. It should be understood that a gasket may also be used with the embodiments of FIGS. 3 and 5 if an improved seal is required.

Figure 8:
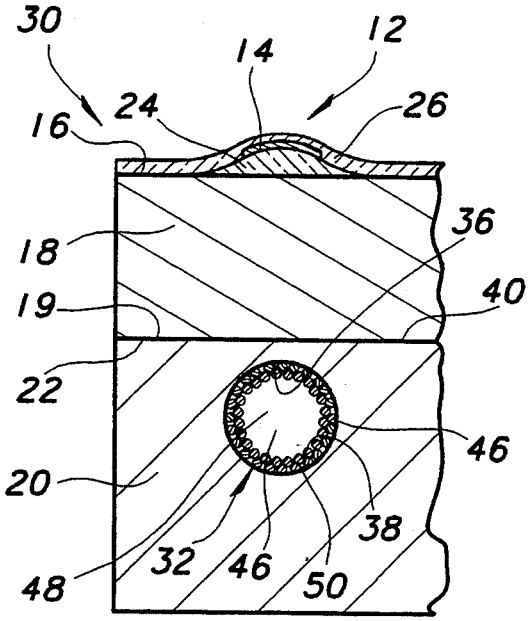
FIG. 8 is a fragmentary, cross-sectional view of an alternative fifth embodiment of the invention.

Another alternative embodiment of the invention is shown in FIG. 8 wherein the chamber 32 is cylindrical in shape and formed fully within the heat sink 20. This embodiment may be particularly useful where mechanical considerations restrict formation of the chamber 32 at the junction of the ceramic substrate 18 and the heat sink 20, or where drilling or otherwise forming a cylindrical bore through the heat sink is preferable to producing a groove in the ceramic substrate or the heat sink. This embodiment is also advantageous where an adequate hermetic seal cannot be provided between the ceramic substrate and the heat sink.

Figure 9:
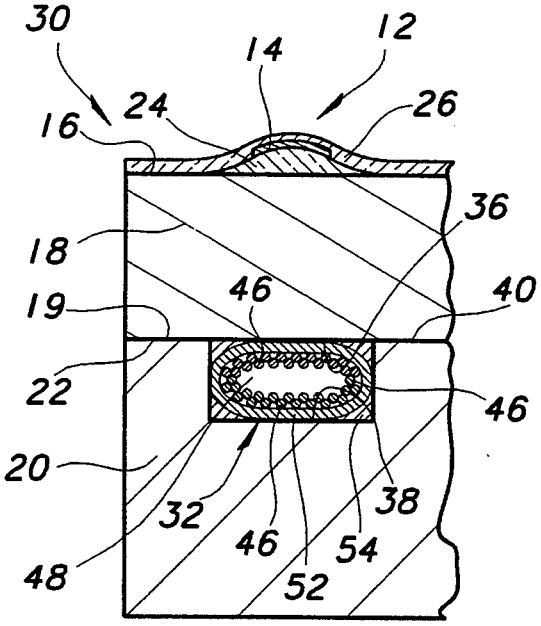
FIG. 9 is a fragmentary, cross-sectional view of an alternative sixth embodiment of the invention.

Each of the previously described embodiments of FIGS. 3–8 has the chamber 32 integrally formed in one or the other or both of the ceramic substrate 18 and the heat sink 20 utilizing the end plug 44 and the integrally formed end wall 42. In an alternative embodiment of the invention shown in FIG. 9, the chamber 32 is constructed as a tube 52 with both of its ends sealed. The tube 52 has the wicks 46 and the heat transfer fluid 50 sealed therewithin. The tube 52 is manufactured as a discrete and separate component which is positioned in the groove 38 in the heat sink 20 in thermal contact with the heat sink and the lower surface 22 of the ceramic substrate 18. Alternatively, the tube 52 may be positioned in the groove 36 of the ceramic substrate 18, but in both situations the tube is located below the heating elements 14 and oriented in colinear alignment with the array 12. To improve thermal conduction and to secure the tube 52 in place within the groove 38, a filling and bonding material 54 such as epoxy is used.

Figure 10:
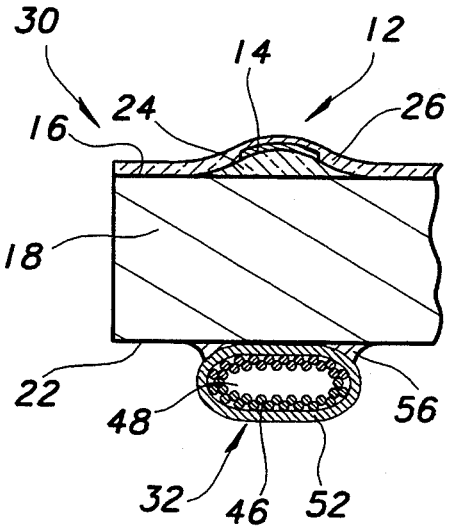
FIG. 10 is a fragmentary, cross-sectional view of an alternative seventh embodiment of the invention.

An alternative embodiment using the tube 52 is shown in FIG. 10. In this embodiment, the tube 52 is mechanically attached to the lower surface 22 of the ceramic substrate 18 using an adhesive 56 without the need for the heat sink 20. Preferably, the adhesive 56 is selected as a material that provides improved thermal conduction.

Figure 11:
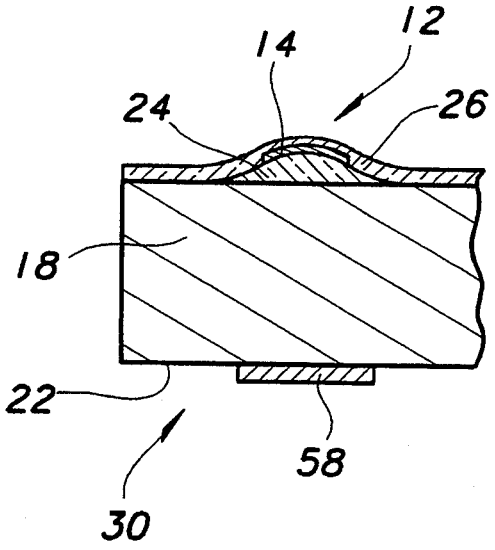
FIG. 11 is a fragmentary, cross-sectional view of an alternative eighth embodiment of the invention.

Each of the previously discussed embodiments of the invention utilizes the chamber 32 containing the heat transfer fluid 50. An alternative embodiment of the invention is shown in FIG. 11 using a thermally conductive strip 58 attached to the lower surface 22 of the ceramic substrate 18. The thermally conductive strip is preferably manufactured from a highly thermally conductive material, such as a metal having a greater thermal conductivity than the ceramic substrate 18. As with the chamber 32, the thermally conductive strip 56 is located below the heating elements 14 and oriented in colinear alignment with the array 12 to absorb heat generated by the heating elements.

The thermally conductive strip 58 may be formed in a number of manners, such as by embedding a conductive metal strip of high thermal diffusivity within the ceramic substrate 18. Other techniques and materials for forming the thermally conductive strip 58 will be obvious to those skilled in the art.

Figure 12:
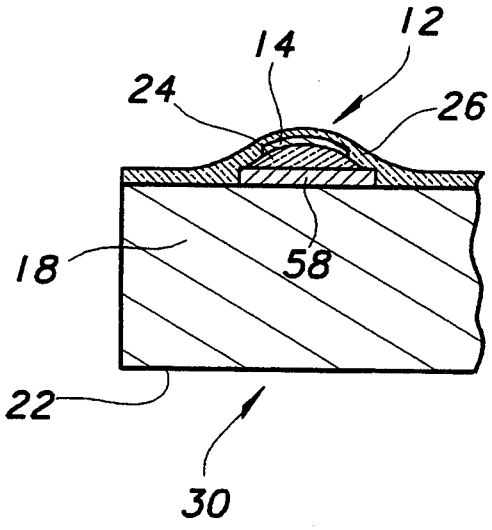
FIG. 12 is a fragmentary, cross-sectional view of an alternative ninth embodiment of the invention.

In an alternative embodiment shown in FIG. 12, the thermally conductive strip 58 is positioned between the underglaze 24 and the ceramic substrate 18, thus being positioned more immediately below the heating elements 14. This provides more responsive lateral transfer of heat between portions of the heating elements 14 of the array 12 than can be achieved by simply using the conventional heat sink 20.

It should be noted that while the heating element array 12 and the chamber 32 and thermally conductive strip 58 have been described and illustrated as being linear, a nonlinear array and correspondingly shaped chamber and strip may be used. Additionally, the heating elements 14 may be formed as discontinuous segments.

While the above-described embodiments demonstrate the presently preferred embodiments of the invention, other variations will be apparent to one skilled in the art. For example, the heat transfer fluid may be used without a wick if other means are provided to return the transfer fluid.

It will also be appreciated that the foregoing disclosure is given for purposes of illustration, and various modifications and variations may be made without departing from the spirit and scope of the invention.

We claim:

1. A thermal printhead for printing on a thermally sensitive print medium, the print medium being movable relative to the printhead in a direction of printing, comprising:

a support base having a first side positionable toward the print medium and a reverse second side;

a plurality of heating elements mechanically attached to the first side of the support base, the heating elements being arranged to define an array extending in an array direction generally transverse to the direction of printing, the heating elements generating heat when activated for thermal printing and being positioned in proximity with the print medium to transfer a portion of the generated heat thereto during thermal printing, the heating elements retaining a portion of the generated heat as residual heat; and an elongated heat conduction member coupled to the support base in the thermal contact with the plurality of heating elements to absorb heat generated by the heating elements and being oriented in general alignment with the array to distribute any absorbed heat along the array in the array direction, the conduction member distributing the residual heat generated by any heating elements along a first portion of the array greater than the residual heat generated by other heating elements along a second portion of the array to the other heating elements to equalize heating element temperatures along the array, the conduction member being a fluid-tight conduction chamber containing a heat transfer fluid in a liquid state which changes to a gaseous state above a preselected temperature, the heating elements along the first portion of the array generating temperatures in the conduction chamber along the first portion of the array below the preselected temperature when operating under a normal activation schedule and the heating elements generating temperatures in the conduction chamber along the first portion of the array at or above the preselected temperature when the heating elements along the first portion of the array are operating under a heavier than normal activation schedule, such that the residual heat generated by the heating elements along the first portion of the array operating under the heavier than normal activation schedule will generate a temperature in the conduction chamber along the first portion of the array above the preselected temperature and cause the heat transfer fluid to change from the liquid state to the gaseous state, and while in the gaseous state the heat transfer fluid moves longitudinally through the conduction chamber to a cooler portion thereof whereat the heat transfer fluid returns to the liquid state and transfers heat to the heating elements along the second portion of the array.

2. The printhead of claim 1 wherein the conduction chamber further includes a wick enclosed within and extending longitudinally through the conduction chamber, the wick being comprised of a material which transports the heat transfer fluid when in the liquid state lengthwise along the conduction chamber through capillary action.

3. The printhead of claim 1 wherein the conduction chamber includes a tube having both ends sealed and the heat transfer fluid disposed therewithin.

4. The printhead of claim 1 wherein the conduction member is at least partially embedded within the support base on the second side thereof.

5. The printhead of claim 1 wherein the conduction member is positioned in thermal contact with the second side of the support base.

6. The printhead of claim 5 wherein the conduction member is attached to the second side of the support base.

7. The printhead of claim 1 wherein the conduction member is positioned between the heating elements and the support base.

8. The printhead of claim 1, further including a heat sink having a first side positioned toward and in thermal contact with the second side of the support base.

9. The printhead of claim 8 wherein the conduction member is partially embedded within the support base and partially embedded within the heat sink.

10. The printhead of claim 8 wherein the conduction member is fully embedded within the heat sink.

11. A thermal printhead for printing on a thermally sensitive print medium, the print medium being movable relative to the printhead in a direction of printing, comprising:

a support base having a first side positionable toward the print medium and a reverse second side;

a heat sink having a first side positioned toward and in thermal contact with the second side of the support base;

a plurality of heating elements mechanically attached to the first side of the support base, the heating elements being arranged to define an array extending generally transverse to the direction of printing, the heating elements generating heat when activated for thermal printing and being positioned in proximity with the print medium to transfer heat thereto during thermal printing; and an elongated, fluid-tight heat conduction chamber positioned at least partially within the support base second side or the heat sink first side and, oriented in general alignment with the array, to distribute any absorbed heat along the array, the conduction chamber containing a heat transfer fluid in a liquid state which changes to a gaseous state above a preselected temperature, the heating elements generating temperatures in the conduction chamber below the preselected temperature when operating under a normal activation schedule and the heating elements generating temperatures in the conduction chamber along a first portion of the array at or above the preselected temperature when the heating elements along the first portion of the array are operating under a heavier than normal activation schedule, the heat transfer fluid changing from the liquid state to the gaseous state when the heat generated by the heating elements along the first portion of the array operating under the heavier than normal activation schedule will generate a temperature in the conduction chamber along the first portion of the array above the preselected temperature and while in the gaseous state the heat transfer fluid moving longitudinally through the conduction chamber to a cooler portion thereof whereat the heat transfer fluid returns to the liquid state and transfers heat to the heating elements along a second portion of the array.

12. The printhead of claim 11 wherein the conduction chamber further includes a wick enclosed within and extending longitudinally through the conduction chamber, the wick being comprised of a material which transports the heat transfer fluid when in the liquid state lengthwise along the conduction chamber through capillary action.

13. The printhead of claim 11 wherein at least one of the support base second side or the heat sink first side has a groove formed therein forming an interior sidewall of the conduction chamber and the support base second side is sealed to the heat sink first side to form the fluid-tight conduction chamber.

14. The printhead of claim 13 wherein the support base second side is sealed to the heat sink first side by a gasket positioned therebetween.

15. The printhead of claim 11 wherein the support base second side has a groove therein and the heat sink first side has a corresponding groove therein which together define the conduction chamber, the support base second side and the heat sink first side being sealed together to prevent fluid leakage from the conduction chamber therebetween.

16. The printhead of claim 11 wherein the conduction chamber is an elongated cavity fully within the heat sink.

17. The printhead of claim 11 wherein the conduction chamber includes a tube with sealed ends and the heat transfer fluid is disposed within the tube, and the tube is positioned at least partially within a groove formed in one of the support base second side or the heat sink first side, the tube being in thermal contact With at least one of the support base on the heat sink.

* * * * *

UNITED STATES PATENT AND TRADEMARK OFFICE

CERTIFICATE OF CORRECTION

PATENT NO. : 5,357,271

DATED : October 18, 1994

INVENTOR(S) : Christopher A. Wiklof and Kenneth D. Lakey

It is certified that error appears in the above-indentified patent and that said Letters Patent is hereby corrected as shown below:

On the patent title page, within the title, please delete "LATERLA" and substitute therefor LATERAL--.

In column 8, claim 1, line 51, please delete the first occurring "the".

In column 10, claim 17, line 64, please delete "With" and substitute therefor --with--.

In column 10, claim 17, line 65, please delete "on" and substitute therefor --or--.

Signed and Sealed this

Twenty-eight Day of February, 1995

Bruce Lehman

*Attest:*

BRUCE LEHMAN

*Attesting Officer*

*Commissioner of Patents and Trademarks*